US006910852B2

(12) United States Patent
Simeone et al.

(10) Patent No.: US 6,910,852 B2
(45) Date of Patent: Jun. 28, 2005

(54) METHODS AND APPARATUS FOR COOLING GAS TURBINE ENGINE ROTOR ASSEMBLIES

(75) Inventors: Peter Andrew Simeone, Byfield, MA (US); Dean Thomas Lenahan, Cincinnati, OH (US); Jeremy Stephen Wigon, Chestnut Hill, MA (US); Alan Patrick St. Hilaire, Danvers, MA (US); Dennis Centeno Iglesias, Cambridge, MA (US); James Patrick McGovern, Marblehead, MA (US)

(73) Assignee: General Electric Company, Schenectady, NY (US)

( * ) Notice: Subject to any disclaimer, the term of this patent is extended or adjusted under 35 U.S.C. 154(b) by 145 days.

(21) Appl. No.: 10/656,599

(22) Filed: Sep. 5, 2003

(65) Prior Publication Data

US 2005/0053464 A1 Mar. 10, 2005

(51) Int. Cl.[7] ..... F01D 5/08
(52) U.S. Cl. ..... 415/115; 415/144; 416/220 R
(58) Field of Search ..... 415/115, 144; 416/220 R

(56) References Cited

U.S. PATENT DOCUMENTS 4,086,757 A * 5/1978 Karstensen et al. ..... 415/115
4,190,398 A * 2/1980 Corsmeier et al. ..... 415/114
4,541,774 A * 9/1985 Rieck et al. ..... 415/115
4,882,902 A * 11/1989 Reigel et al. ..... 415/115
4,890,981 A * 1/1990 Corsmeier et al. ..... 416/220 R
5,236,302 A 8/1993 Weisgerber et al.
5,275,534 A 1/1994 Cameron et al.
5,288,210 A 2/1994 Albrecht et al.
5,472,313 A 12/1995 Quinones et al.
5,555,721 A 9/1996 Bourneuf et al.
5,700,130 A * 12/1997 Barbot et al. ..... 415/115
5,984,637 A * 11/1999 Matsuo ..... 416/220 R
6,398,487 B1 * 6/2002 Wallace et al. ..... 415/115

* cited by examiner

*Primary Examiner*—F. Daniel Lopez
*Assistant Examiner*—Igor Kershteyn
(74) *Attorney, Agent, or Firm*—William Scott Andes; Armstrong Teasdale LLP

(57) ABSTRACT

A method facilitates assembling a gas turbine engine. The method comprises providing a rotor assembly including a rotor shaft and a rotor disk that includes a radially outer rim, a radially inner hub, and an integral web extending therebetween, wherein the rotor assembly is rotatable about an axis of rotation extending through the rotor shaft, and coupling a disk retainer including at least one discharge tube to the rotor disk wherein the discharge tube extends outwardly from the disk retainer for pumping the air to a higher pressure before discharging cooling fluid therefrom in a direction that is substantially perpendicular with respect to the axis of rotation.

20 Claims, 2 Drawing Sheets

METHODS AND APPARATUS FOR COOLING GAS TURBINE ENGINE ROTOR ASSEMBLIES

GOVERNMENT RIGHTS STATEMENT

The United States Government has rights in this invention pursuant to Contract No. DAAEO7-00-C-N086.

BACKGROUND OF THE INVENTION

This application relates generally to gas turbine engines and, more particularly, to gas turbine engine rotor assemblies.

A gas turbine engine typically includes a multi-stage axial compressor, a combustor, and a turbine. Airflow entering the compressor is compressed and directed to the combustor where it is mixed with fuel and ignited, producing hot combustion gases used to drive the turbine. To control the heat transfer induced by the hot combustion gases entering the turbine, typically cooling air is channeled through a turbine cooling circuit and used to cool the turbine.

Compressor bleed air is often used as a source of cooling air for the turbine cooling circuit and is also used to purge cavities defined within the engine. More specifically, maintaining sufficient cooling air and purging of air cavities within the gas turbine engine may be critical to proper engine performance and component longevity. However, extracting cooling air from the compressor may affect overall gas turbine engine performance. Balanced with the need to adequately cool components is a desire to maintain high levels of operating efficiency, and as such, generally, because the temperature of air flowing through the compressor increases at each stage of the compressor, utilizing cooling air from the lowest allowable compressor stage results in a lower engine performance decrement as a result of such cooling air extraction. However, within such engines, during at least some engine power settings, the compressor system may fail to provide purge air at a sufficient pressure, and as such hot gases may be still be ingested into the cavities. Over time, continued exposure to such temperature excursions may limit the useful life of components adjacent to the cavities.

BRIEF SUMMARY OF THE INVENTION

In one aspect, a method of assembling a gas turbine engine is provided. The method comprises providing a rotor assembly including a rotor shaft and a rotor disk that includes a radially outer rim, a radially inner hub, and an integral web extending therebetween, wherein the rotor assembly is rotatable about an axis of rotation extending through the rotor shaft, and coupling a disk retainer including at least one discharge tube to the rotor disk wherein the discharge tube extends outwardly from the disk retainer for pumping and then discharging cooling fluid therefrom in a direction that is substantially perpendicular with respect to the axis of rotation.

In another aspect, a rotor assembly for a gas turbine engine including a centerline axis of rotation is provided. The rotor assembly includes a rotor shaft, a rotor disk, and a disk retainer. The rotor disk is coupled to the rotor shaft and includes a radially outer rim, a radially inner hub, and an integral web extending therebetween. The disk retainer is coupled to the rotor disk and includes at least one discharge tube extending radially outwardly from said disk retainer for pumping and then discharging cooling fluid therefrom in a direction that is substantially perpendicular with respect to the gas turbine engine axis of rotation.

In a further aspect, a gas turbine engine including a rotor assembly is provided. The rotor assembly includes a rotor shaft, a rotor disk, and a disk retainer. The rotor shaft has a centerline axis of rotation. The rotor disk is coupled to the rotor shaft and includes a radially outer rim, a radially inner hub, and an integral web extending therebetween. The disk retainer is coupled to the rotor disk and includes at least one discharge tube extending radially outwardly from the disk retainer. The discharge tube pumps and then discharges cooling fluid in a direction that is substantially perpendicular to the rotor shaft axis of rotation.

DETAILED DESCRIPTION OF THE INVENTION

Figure 1:
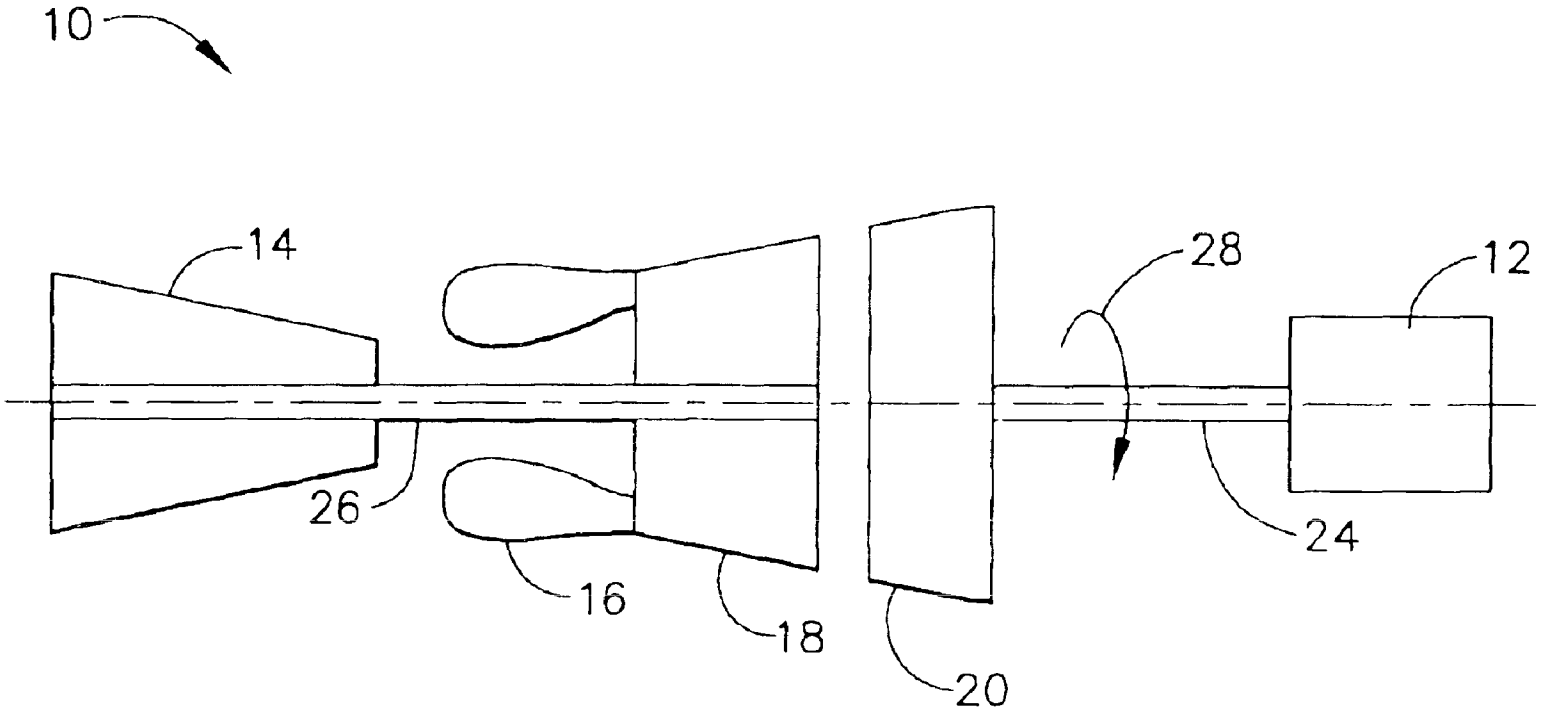
FIG. 1 is a schematic illustration of a gas turbine engine.

FIG. 1 is a schematic illustration of a gas turbine engine 10 including a gear box 12, a high pressure compressor 14, and a combustor 16. Engine 10 also includes a high pressure turbine 18 and a low pressure turbine 20. Gear box 12 and turbine 20 are coupled by a first shaft 24, and compressor 14 and turbine 18 are coupled by a second shaft 26. Accordingly, because shafts 24 and 26 are aligned substantially coaxially, each is rotatable about the same axis of rotation 28. In one embodiment, the gas turbine engine is an LV100 available from General Electric Company, Cincinnati, Ohio.

In operation, air flows through compressor 14. The highly compressed air is delivered to combustor 16. Airflow from combustor 16 drives turbines 18 and 20 before exiting gas turbine engine 10. Work done by turbine 20 is then transmitted to gearbox 12 by means of shaft 24 wherein the available work can then be used to drive a vehicle or generator.

Figure 2:
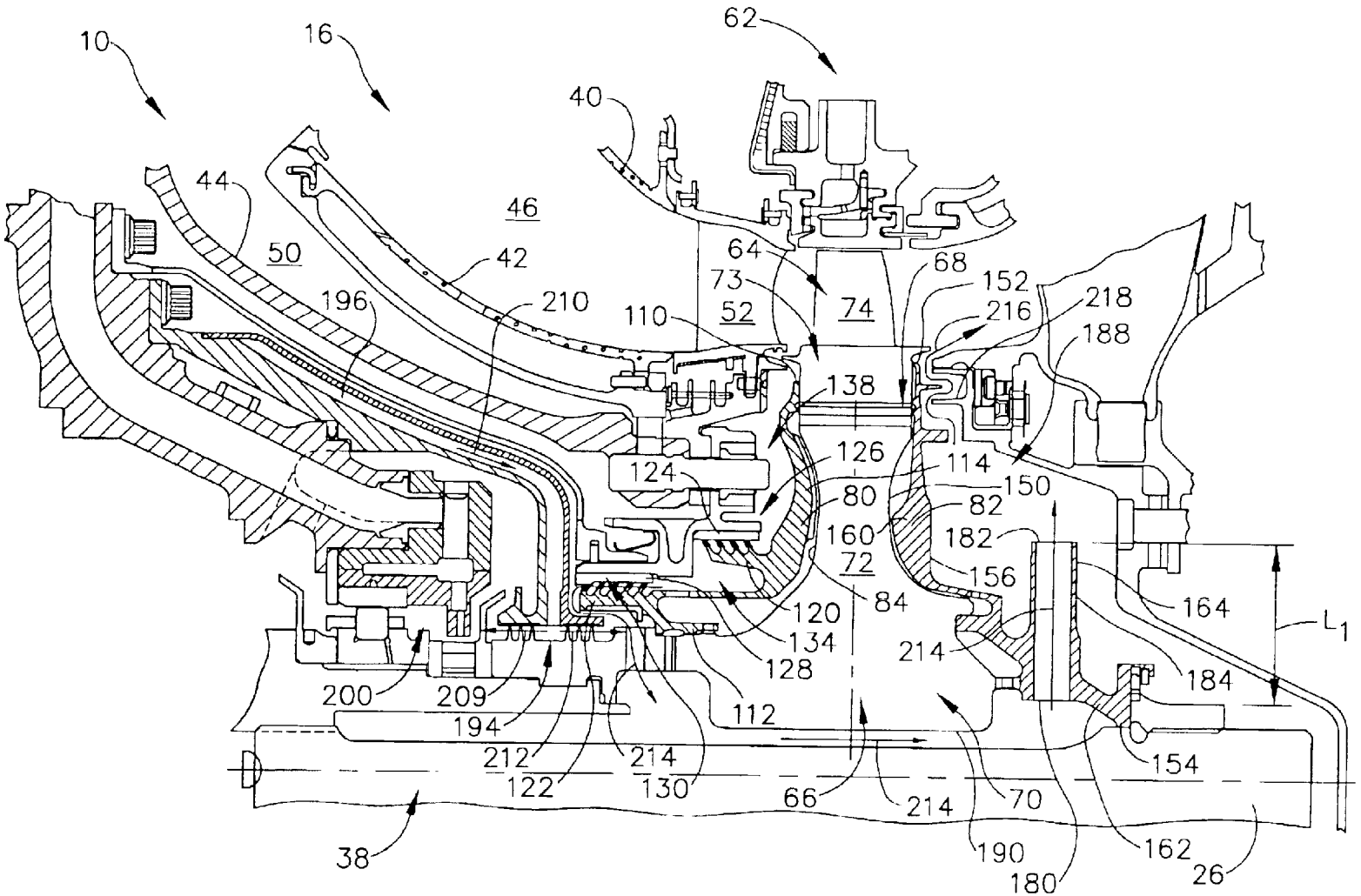
FIG. 2 is a side cross-sectional schematic illustration of a turbine cooling circuit used with the gas turbine engine shown in FIG. 1.

FIG. 2 is a side cross-sectional schematic illustration of a turbine cooling circuit 38 that may be used with gas turbine engine 10. Combustor 16 includes an annular outer liner 40, an annular inner liner 42, and a domed end (not shown) extending between outer and inner liners 40 and 42, respectively. Outer liner 40 and inner liner 42 are spaced radially inward from a combustor casing (not shown) and define a combustion chamber system assembly 46. An inner nozzle support 44 is generally annular and extends downstream from a diffuser (not shown). Combustion chamber 46 is generally annular in shape and is defined between liners 40 and 42. Inner liner 42 and inner nozzle support 44 define an inner passageway 50. Outer and inner liners 40 and 42 each extend to a turbine nozzle 52 positioned downstream from combustor 16.

High pressure turbine 18 is coupled substantially coaxially with compressor 14 (shown in FIG. 1) and downstream from combustor 16. Turbine 18 includes a rotor assembly 62 that includes at least one rotor 64 that may be formed by one or more disks 66. In the exemplary embodiment, disk 66 includes a radially outer rim 68, a radially inner hub 70, and an integral web 72 extending generally radially therebetween and radially inward from a respective blade dovetail slot 73. Each disk 66 also includes a plurality of blades 74 extending radially outward from outer rim 68. Disk 66 extends circumferentially around rotor assembly 62 and each row of blades 74 is sometimes referred to as a turbine stage.

An annular forward disk retainer 80 and an annular aft disk retainer 82 extend along dovetail slot 73 to facilitate retaining rotor blades 74 within dovetail slot 73. Specifically, forward disk retainer 80 extends along an upstream side 84 of disk 66 and includes a radially outer end 110, a radially inner end 112, and a body 114 extending therebetween. Body 114 includes a plurality of radially outer seal teeth 120 and a plurality of radially inner seal teeth 122. Radially outer seal teeth 120 cooperate with a seal member 124 to form an outer balance piston (OBP) seal 126, and radially inner seal teeth 122 cooperate with a seal member 128 to form an inner balance piston (IBP) seal 130. An accelerator discharge cavity 134 is defined between IBP seal 130 and OBP seal 126, and OBP seal 126 is positioned between cooling cavity 134 and an outer balance piston discharge cavity 138.

Aft disk retainer 82 extends along a downstream side 150 of disk 66 and includes a radially outer end 152, a radially inner end 154, and a body 156 extending therebetween. Body 156 includes a cooling plate portion 160, a disk stub shaft portion 162, and a plurality of radial air pumpers 164 positioned therebetween. Cooling plate portion 160 is coupled against disk 66 with a radial interference fit and extends from retainer outer end 152 to each radial air pumper 164. Disk stub shaft portion 162 is oriented generally perpendicularly from retainer portion 160 and extends along rotor shaft 26. More specifically, disk stub shaft portion 162 extends from radial air pumpers 164 to retainer end 154 to facilitate aft disk retainer 82 being coupled to shaft 26 such that a compressive load is induced through shaft portion 162 to retainer 82.

Radial air pumpers 164 are spaced circumferentially within engine 10 and each is oriented substantially perpendicularly to axis of rotation 28. In the exemplary embodiment, aft disk retainer 82 includes eight radial air pumpers 164. Each radial air pumper 164 is hollow and includes an inlet 180, an outlet 182 that is radially outward from inlet 182, and a substantially cylindrical body 184 extending therebetween. Each radial air pumper 164 has a length $L_1$ that enables each pumper 164 to extend at least partially into an aft rim cavity 188 bordered at least partially by aft disk retainer 82. Furthermore radial air pumper length $L_1$ also facilitates maintaining or accelerating the angular air velocity of air flowing through pumpers 164, and increasing the discharge pressure of such air relative to a weaker forced vortex pressure rise which would occur without the use of pumpers 164.

Each radial air pumper inlet 180 is coupled in flow communication with a bore cavity 190. Bore cavity 190 is defined at least partially between disk 66 and shaft 26. Bore cavity 190 extends axially between, and is coupled in flow communication to, each radial air pumper 164 and to a sump buffer cavity 194. Sump buffer cavity 194 is also coupled in flow communication to an air source through an annulus 196, such that air discharged from annulus 196 enters sump buffer cavity 194 prior to being discharged into a sump 200. As described in more detail below, leakage from sump buffer cavity 194 is channeled to bore cavity 190.

Cooling circuit 38 is in flow communication with an air source, such as compressor 14 and turbine 20 and supplies cooling air from compressor 14 to facilitate cooling turbine 20. During operation, air discharged from compressor 14 is mixed with fuel and ignited to produce hot combustion gases. The resulting hot combustion gases drive turbine 20. Simultaneously, a portion of air is extracted from compressor 14 to cooling circuit 38 to facilitate cooling turbine components and purging cavities.

Specifically, at least a portion of air extracted from compressor 14 is channeled through an accelerator prior to being discharged into accelerator discharge cavity 134. Cooling air 209 supplied from sump buffer cavity 194 is channeled into sump 200. A portion 212 of air 210 supplied to buffer cavity 194 is mixed with air 214 leaking from discharge cavity 134 through IBP seal 130 and is channeled into bore cavity 190. Leakage of air 212 from sump buffer cavity 194 facilitates preventing ingestion of warm compressor discharge air within sump 200. More specifically, because air 214 flowing into bore cavity 190 is discharged through pumpers 164, the operating pressure within bore cavity 190 is decreased, such that pumpers 164 facilitate positively purging cavity 190 and preventing flow 212 from reversing direction. Moreover, because the discharge pressure of air 214 flowing through pumpers 164 is increased, pumpers 164 also facilitate positively purging aft rim cavity 188.

Flow 216 discharged from aft rim cavity 188 is forced radially outwardly between a disk seal assembly 82 and an aft transition duct inner flow path buffer seal 218 to facilitate cooling of outer rotor rim 68 and disk seal assembly 82. Moreover, purging of cavities 190 and 188 facilitates preventing ingestion of warm compressor discharge therein, which over time, could cause damage to components housed within, adjacent to, or in flow communication with cavities 188 and 190.

The above-described turbine cooling circuit is cost-effective and highly reliable. The cooling circuit includes an aft disk retainer that is formed integrally with a shaft stub portion and with a plurality of radial air pumpers. Because the retainer is formed integrally with a cooling plate portion and a disk stub portion, manufacturing costs, and turbine assembly times are facilitated to be reduced. Moreover, because the radial pumpers increase a discharge pressure of air flowing therethrough, the pumpers facilitate positively purging the aft rim cavity and the bore cavity thus ensuring purge flow from the sump buffer cavity. Accordingly, the pumpers thus facilitate preventing warm compressor discharge from being ingested within the aforementioned cavities. As a result, the aft rotor retainer assembly and the cooling circuit facilitates extending a useful life of the turbine rotor assembly in a cost-effective and reliable manner.

Exemplary embodiments of rotor assemblies and cooling circuits are described above in detail. The rotor assemblies are not limited to the specific embodiments described herein, but rather, components of each assembly may be utilized independently and separately from other components described herein. For example, each aft retainer assembly component can also be used in combination with other cooling circuit components and with other rotor assemblies.

While the invention has been described in terms of various specific embodiments, those skilled in the art will recognize that the invention can be practiced with modification within the spirit and scope of the claims.

What is claimed is:

1. A method of assembling a gas turbine engine, said method comprising:

providing a rotor assembly including a rotor shaft and a rotor disk that includes a radially outer rim, a radially inner hub, and an integral web extending therebetween, wherein the rotor assembly is rotatable about an axis of rotation extending through the rotor shaft; and coupling a disk retainer including at least one discharge tube to the rotor disk wherein the discharge tube extends outwardly from the disk retainer for pumping and then discharging cooling fluid therefrom in a direction that is substantially perpendicular with respect to the axis of rotation.

2. A method in accordance with claim 1 wherein coupling a disk retainer including at least one discharge tube to the rotor disk further comprises coupling a disk retainer to the rotor disk such that the at least one discharge tube is positioned between an aft cooling plate and an integrally-formed disk stub shaft.

3. A method in accordance with claim 2 wherein coupling a disk retainer to the rotor disk further comprises coupling the disk retainer to the rotor disk such that the aft cooling plate is coupled against the rotor disk web and such that the disk stub shaft is coupled to the rotor shaft.

4. A method in accordance with claim 2 wherein coupling a disk retainer including at least one discharge tube to the rotor disk further comprises coupling the disk retainer to the rotor disk such that the at least one discharge tube is coupled in flow communication to a bore cavity defined at least partially by the rotor disk radially inner hub.

5. A method in accordance with claim 2 wherein coupling a disk retainer including at least one discharge tube to the rotor disk further comprises coupling an annular disk retainer to the rotor disk that includes a plurality of discharge tubes spaced circumferentially around the rotor shaft.

6. A rotor assembly for a gas turbine engine including a centerline axis of rotation, said rotor assembly comprising:

a rotor shaft;

a rotor disk coupled to said rotor shaft and comprising a radially outer rim, a radially inner hub, and an integral web extending therebetween; and a disk retainer coupled to said rotor disk and comprising at least one discharge tube extending radially outwardly from said disk retainer for pumping and then discharging cooling fluid therefrom in a direction that is substantially perpendicular with respect to the gas turbine engine axis of rotation.

7. A rotor assembly in accordance with claim 6 further comprising a cooling circuit in flow communication with disk retainer discharge tube, said cooling circuit configured to supply bleed air to said at least one discharge tube, said at least one discharge tube discharges cooling fluid downstream from said rotor disk radially outer rim.

8. A rotor assembly in accordance with claim 6 wherein said disk retainer further comprises a disk stub shaft and an integral aft cooling plate, said at least one discharge tube between said disk stub shaft and said aft cooling plate, said disk stub shaft coupled to said rotor shaft.

9. A rotor assembly in accordance with claim 6 further comprising a cooling circuit coupled in flow communication to a cooling fluid source, a bore cavity, and to said at least one discharge tube, said bore cavity defined at least partially by said rotor disk hub, said at least one discharge tube for pumping and then discharging cooling fluid from said bore cavity.

10. A rotor assembly in accordance with claim 9 wherein said at least one discharge tube facilitates discharging cooling fluid at a positive pressure downstream from said rotor disk radially outer rim.

11. A rotor assembly in accordance with claim 6 wherein said at least one discharge tube comprises a plurality of circumferentially-spaced discharge tubes extending around the gas turbine engine axis of symmetry.

12. A rotor assembly in accordance with claim 6 wherein said at least one discharge tube is configured to increase the pressure of cooling fluid flowing therethrough.

13. A gas turbine engine comprising a rotor assembly comprising a rotor shaft, a rotor disk, and a disk retainer, said rotor shaft having a centerline axis of rotation, said rotor disk coupled to said rotor shaft and comprising a radially outer rim, a radially inner hub, and an integral web extending therebetween, said disk retainer coupled to said rotor disk and comprising at least one discharge tube extending radially outwardly from said disk retainer, said discharge tube for discharging cooling fluid in a direction that is substantially perpendicular to said rotor shaft axis of rotation.

14. A gas turbine engine in accordance with claim 13 further comprising a cooling circuit comprising a sump buffer cavity and a bore cavity, said bore cavity coupled in flow communication with said sump buffer cavity, said bore cavity defined at least partially by said rotor disk inner hub and coupled in flow communication to said at least one discharge tube.

15. A gas turbine engine in accordance with claim 14 wherein said cooling circuit supplies cooling fluid to said at least one discharge tube, said at least one discharge tube discharges cooling fluid from said bore cavity into a cavity defined downstream from said rotor disk radially outer rim.

16. A gas turbine engine in accordance with claim 14 wherein said disk retainer further comprises a disk stub shaft and an aft cooling plate, said at least one discharge tube is between said disk stub shaft and said aft cooling plate, said disk stub shaft coupled to said rotor shaft, said aft cooling plate is coupled against said rotor disk web.

17. A gas turbine engine in accordance with claim 14 wherein said disk retainer at least one discharge tube facilitates pressurizing cooling fluid flowing therethrough.

18. A gas turbine engine in accordance with claim 14 wherein said disk retainer at least one discharge tube comprises a plurality of discharge tubes spaced circumferentially around the gas turbine engine axis of symmetry.

19. A gas turbine engine in accordance with claim 14 wherein said disk retainer at least one discharge tube facilitates reducing an operating pressure within said bore cavity.

20. A gas turbine engine in accordance with claim 14 wherein said disk retainer at least one discharge tube facilitates extending a useful life of said rotor assembly.

* * * * *